United States Patent [19]

Newman

[11] 3,967,339

[45] July 6, 1976

[54] ROLLER FOR REMOVING WATER FROM AND SIMULTANEOUSLY DRYING HARD SURFACES

[75] Inventor: C. Ray Newman, Houston, Tex.

[73] Assignee: Rol-Dri, Inc., Houston, Tex.

[22] Filed: Dec. 6, 1974

[21] Appl. No.: 530,124

Related U.S. Application Data

[63] Continuation-in-part of Ser. No. 412,230, Nov. 2, 1973, abandoned.

[52] U.S. Cl. ..... 15/244 A; 15/98; 15/230.11; 134/6

[51] Int. Cl.[2] ..... A47L 13/11

[58] Field of Search ..... 134/6; 15/97 R, 98, 15/105, 116 A, 118, 119 A, 230.11, 244 R, 244 A, 244 C, 250.37, 250.42; 401/21, 208; 34/95.3

[56] References Cited

UNITED STATES PATENTS

| | | | |
|---|---|---|---|
| 2,073,726 | 3/1937 | Bates | 15/119 A |
| 2,873,462 | 2/1959 | Green | 15/119 A |
| 3,551,934 | 1/1971 | Franzreb | 15/97 R |
| 3,597,785 | 8/1971 | Zinda | 15/105 X |

FOREIGN PATENTS OR APPLICATIONS

| | | | |
|---|---|---|---|
| 630,953 | 7/1963 | Belgium | 15/98 |

OTHER PUBLICATIONS

"Foamed Polyurethanes," *British Plastics*, vol. 29, No. 1, Jan. 1956, pp. 5–9.

*Primary Examiner*—S. Leon Bashore
*Assistant Examiner*—Richard V. Fisher
*Attorney, Agent, or Firm*—Michael P. Breston

[57] ABSTRACT

This invention relates to a roller for moving water on and simultaneously drying very large, flat hard surfaces such as tennis courts. The roller has an outer sleeve which is made from a foam whose compression load density and porosity values fall within critical ranges. The roller moves the water in the rolling direction as it simultaneously establishes a moving seal with the portion of the hard surface over which the roller rides.

1 Claim, 5 Drawing Figures

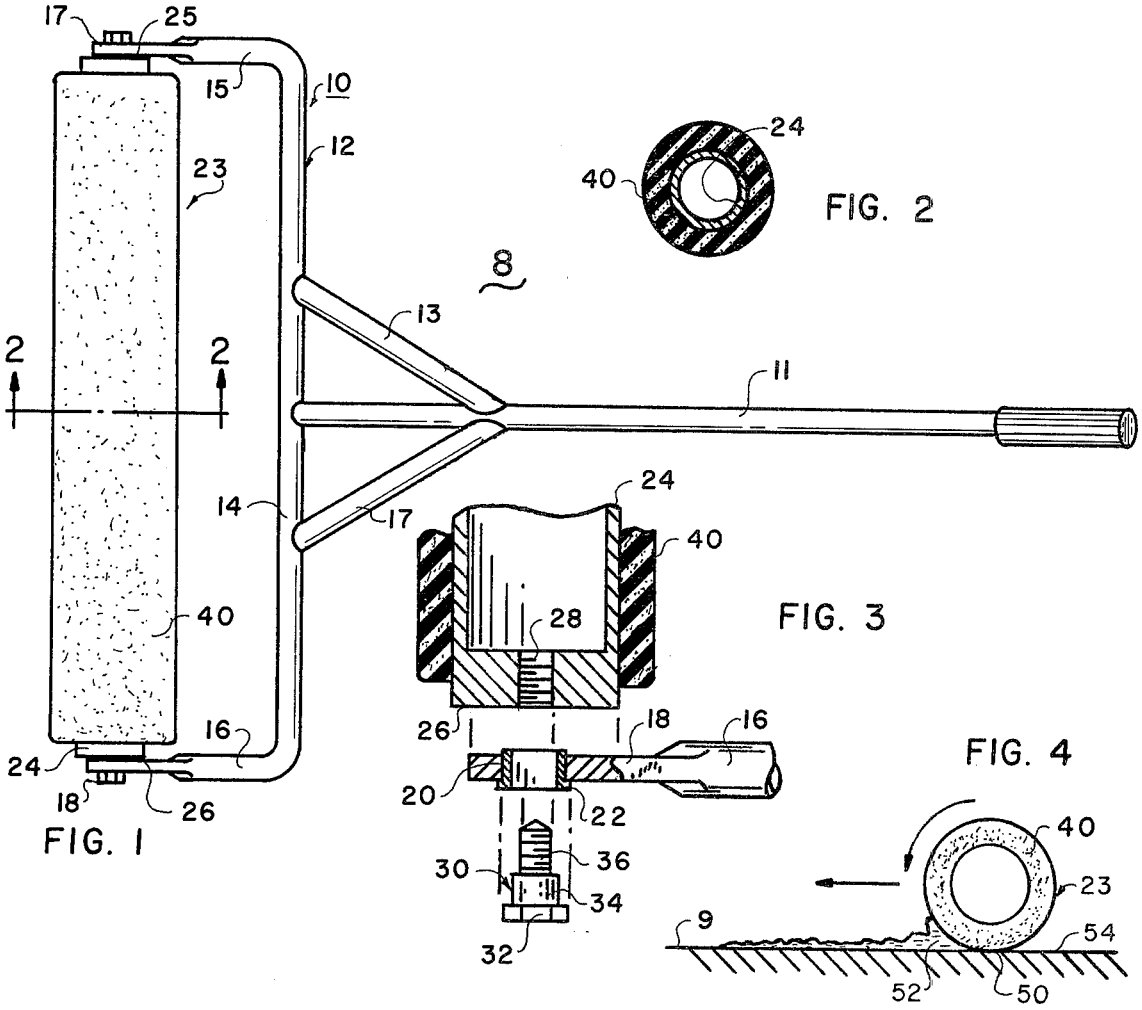
FIG. 1
FIG. 2
FIG. 3
FIG. 4
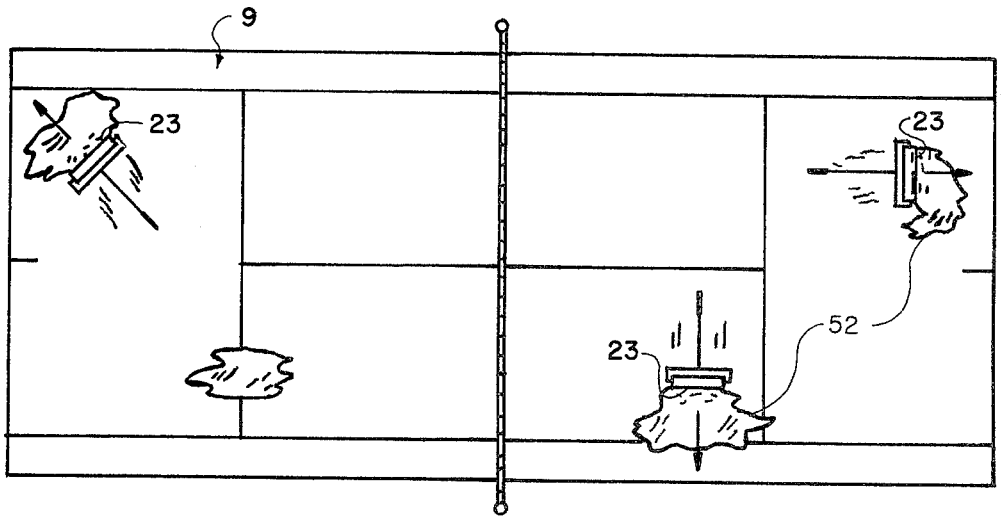
FIG. 5

ROLLER FOR REMOVING WATER FROM AND SIMULTANEOUSLY DRYING HARD SURFACES

REFERENCE TO RELATED APPLICATION

This application is a continuation-in-part of my copending application Ser. No. 412,230 filed on Nov. 2, 1973 and now abandoned.

BACKGROUND OF THE INVENTION

Tennis players are well aware of the problems associated with drying tennis courts after a rain. It is important to make certain that all of the water has been cleared from a tennis court prior to allowing the tennis players to play thereon. The patent literature suggests the use of very light weight rollers for tennis courts with rollers made of open-cell spongy material for absorbing water. Such rollers are incapable of simultaneously moving the water on and drying a tennis court.

The prior art device universally used is called a "squeegee" which comprises a hard rectangular rubber strip mounted on a metal bracket. A long pole is secured to the bracket. In use, the squeegee is slidingly moved over the tennis court to push the water off from the court's surface. The squeegee has well known drawbacks chief among which are: the hard rubber strip is destructive to the court's textured surface, and a considerable effort is required to push it forward. Since in practice tennis courts do not have an ideal flat surface, it results that even after many passes with a squeegee, pockets of water will remain in spaced-apart depressions on the tennis court.

SUMMARY OF THE INVENTION

This invention relates to medium-weight rollers for removing water from and simultaneously drying hard surfaces such as tennis courts. The roller's outer sleeve is made from a partially-open cell foam which is only slightly water-absorbing. The foam must have density and porosity values falling within critical ranges. The roller establishes a seal thereby moving the water and simultaneously drying the tennis court without leaving a layer of water behind it.

Accordingly, it is a main object of the invention to provide, for use on hard surfaces, a new and improved liquid-clearing roller which is especially effective in removing water from tennis courts.

It is another object of this invention to provide such a new and improved roller which can remove the water from and simultaneously dry the surface of a tennis court with a minimum wear on the court.

Yet, it is another object of this invention to provide a new and improved roller which is relatively inexpensive to manufacture and which can remove water from hard surfaces in a relatively short time and with a minimum of muscular effort.

BRIEF DESCRIPTION OF THE DRAWINGS

FIG. 1 is a view in perspective of a preferred embodiment of a liquid removing roller in accordance with this invention;

FIG. 2 is a sectional view taken on line 2—2 in FIG. 1;

FIG. 3 is a partial, enlarged end view of the roller carriage;

FIG. 4 illustrates the simultaneous water removing and drying functions of the roller; and FIG. 5 illustrates the use of the roller for drying tennis courts.

The invention will be illustrated with reference to a presently preferred roller device, generally designated as 8, which is especially useful for removing water from and drying tennis courts 9. While roller device 8 is illustrated for drying tennis courts, it will be understood that this invention has application to hard surfaces other than tennis courts, such as decks on ships, golf greens, swimming pool decks, etc.

The preferred roller device includes a carriage 10 having a C-shaped bracket 12 consisting of a lateral bar 14 and two outwardly extending ends 15–16, respectively having ears 17–18. Each ear has a hole 20 housing a sleeve bearing 22. Bracket 12 is provided with a long handle 11 and preferably with two reinforcing structural members 13 and 17.

The roller itself is generally designated at 23. It has a cylinder 24 with closed ends 25, 26. Each end has a threaded center bore 28. A bushing, generally designated as 30, has a nut portion 32, a reduced cylindrical bearing portion 34, and a threaded end portion 36 adapted to be threaded into bore 28 (FIG. 3). Secured in any suitable manner, as by gluing, to the outer surface of cylinder 24 is a cylindrical sleeve 40 which extends substantially over the cylinder's entire length between ends 25 and 26.

The material used to make sleeve 40 must have a balanced composition of chemical and physical characteristics and parameters whose ranges are critical if it is desired to obtain the benefits of this invention. After considerable experimentation, I have found that this material must have the following properties in a decreasing order of importance:

TABLE I a. a compression load density — between 20 to 60 pounds
b. a density — between 1 to 4 pounds per cubic foot
c. a tear strength — between 0.25 to 0.45 pounds per inch
d. a tensile strength — between 15 to 40 pounds per sq. inch
e. a slight porosity — between 50 to 100 pores per linear in.
f. an elongation factor — between 100 to 400%.

In the preferred embodiment, sleeve 40 was made of an abrasion-resistant, only slightly water-absorbing ester base, flexible polyurethane foam. To be only slightly water absorbing, this foam must have a partially open-cell structure. The ester base makes the foam exceptionally resistant to exposure to sunlight, stable over a wide temperature range, capable of withstanding friction against hard surfaces, and durable even when used over hard textured surfaces.

A balanced formulation in the preferred embodiment of sleeve 40 is given in Table II.

TABLE II a. compression load density — 32 pounds
b. density — 1.5 pounds per cubic foot
c. tear strength — 0.35 pounds per inch
d. tensile strength — 25 pounds per square inch
e. porosity — 60 to 70 pores per linear inch
f. elongation factor — 350%

With the above characteristics, sleeve 40 is relatively soft and therefore, in use, roller 23 pushes the water in the rolling direction indicated by the arrow (FIG. 4) in an almost effortless manner. Since the roller exerts no appreciable pressure on the tennis court, the court's surface 9 will therefore have a longer useful life.

The roller's sleeve 40 establishes an effective moving seal 50 (FIGS. 4, 5) with the hard surface 9. Sleeve 40 is sufficiently resilient to follow the contours of the court's surface which frequently has irregularities therein. Seal 50 prevents water puddle 52 in front of roller 23 from moving past the seal to the back 54 of the roller. Since sleeve 40 is only slightly water absorbing, it will not carry appreciable water therein. Therefore the back portion 54 remains dry. In sum, as roller 23 pushes the water 52 in front of it, it also and simultaneously drys the portion 54 of the tennis court 9 in back of the roller. Thus the sealing characteristic of sleeve 40 is essential for proper operation thereof. To obtain an effective moving seal, the properties (a), (b) and (e) of Table I must be properly selected from within the specified ranges.

In the preferred embodiment sleeve 40 had a 1½ inch thickness; cylinder or core 24 was of metal and had a 2 inch diameter and a length varying from 3 to 6 feet.

While this invention has been described and illustrated with reference to a presently preferred embodiment, it will be apparent to those skilled in the art that various modifications in the design as illustrated may be made without departing from the scope of the invention as defined in the attached claims.

I claim:

1. A liquid-removing device adapted to remove a liquid body lying on a substantially flat hard surface, said device comprising:

a carriage;

a resilient foam roller having a high abrasion-resistance and being characterized by a compression load density between 20 to 60 pounds, by a density between 1 to 4 pounds per cubic foot, by a porosity between 50 to 100 pores per linear inch, by a tear strength between 0.25 to 0.45 pounds per inch, by an elongation factor between 100 to 400%, and by a tensile strength between 15 to 40 pounds per square inch; and means rotatably supporting said roller on said carriage whereby, in use, a moving seal is established between said roller and said surface.

* * * * *